US011198544B2

(12) United States Patent
Loya

(10) Patent No.: US 11,198,544 B2
(45) **Date of Patent: *Dec. 14, 2021**

(54) CAP HAVING A SPOON-SHAPED CLOSURE

(71) Applicant: Spoonfuls, Inc., Oldwick, NJ (US)

(72) Inventor: Heather Baird Loya, Oldwick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/103,499

(22) Filed: Nov. 24, 2020

(65) Prior Publication Data

US 2021/0078775 A1 Mar. 18, 2021

Related U.S. Application Data

(63) Continuation of application No. 16/525,305, filed on Jul. 29, 2019, now Pat. No. 10,843,848.

(60) Provisional application No. 62/860,153, filed on Jun. 11, 2019, provisional application No. 62/757,587, filed on Nov. 8, 2018, provisional application No. 62/711,374, filed on Jul. 27, 2018.

(51) Int. Cl.

| | |
|---|---|
| ***B65D 47/08*** | (2006.01) |
| ***B65D 41/26*** | (2006.01) |
| *B65D 47/06* | (2006.01) |
| *B65D 47/14* | (2006.01) |
| *A61J 7/00* | (2006.01) |
| *B65D 41/04* | (2006.01) |

(52) U.S. Cl.

CPC ..... *B65D 47/0838* (2013.01); *A61J 7/0023* (2013.01); *B65D 41/0464* (2013.01); *B65D 41/26* (2013.01); *B65D 47/06* (2013.01); *B65D 47/0804* (2013.01); *B65D 47/0833* (2013.01); *B65D 47/142* (2013.01); *B65D 2547/063* (2013.01)

(58) Field of Classification Search

CPC .... B65D 47/0838; B65D 47/06; B65D 41/26; B65D 47/142; B65D 47/0833; B65D 47/0804; B65D 2547/063; B65D 41/0464; A61J 7/0023

See application file for complete search history.

(56) References Cited

U.S. PATENT DOCUMENTS

| | | | |
|---|---|---|---|
| 1,784,880 | A | 12/1930 | Phillipson |
| 2,063,288 | A | 12/1936 | Allen, Jr. |
| 2,591,207 | A | 4/1952 | Sepesy |
| 3,116,152 | A | 12/1963 | Smith |
| 3,208,625 | A | 9/1965 | Bernini |
| 3,255,928 | A | 6/1966 | Foster |
| 3,312,366 | A | 4/1967 | Poris |
| 3,383,018 | A | 5/1968 | Grimsley |
| 3,428,099 | A | 2/1969 | Tenenouser |
| 3,730,372 | A | 5/1973 | Komendowski |

(Continued)

*Primary Examiner* — Frederick C Nicolas

(57) ABSTRACT

A cap for use with a container may include a body having an opening extending there through. The opening may include a product pathway extending from an upper surface of the body, a flow restrictor, and a coupling mechanism configured to removably couple the body to the container. The cap may also include a closure coupled to the body. The closure may selectively cover the opening and include a spoon shape having a concave surface. The body may further include a stop to limit rotation of the closure relative to the body. The body and/or a container configured for use with the body may further include a child lock feature.

13 Claims, 14 Drawing Sheets

(56) References Cited

U.S. PATENT DOCUMENTS

| | | | | |
|---|---|---|---|---|
| 3,804,282 | A | 4/1974 | Komendowski | |
| 3,927,805 | A * | 12/1975 | Stull | B65D 47/148 222/153.14 |
| 3,955,742 | A | 5/1976 | Marshall et al. | |
| 4,116,351 | A | 9/1978 | Uhlig | |
| 4,373,640 | A | 2/1983 | Resio | |
| 4,464,316 | A | 8/1984 | Michaels | |
| 4,512,484 | A | 4/1985 | Mar | |
| 4,724,615 | A | 2/1988 | Mackles et al. | |
| 4,830,222 | A | 5/1989 | Read | |
| 4,838,441 | A | 6/1989 | Chernack | |
| 4,915,268 | A | 4/1990 | Lay | |
| 5,007,555 | A | 4/1991 | Beck | |
| 5,038,974 | A | 8/1991 | Da Costa | |
| 5,106,221 | A | 4/1992 | Diot et al. | |
| 5,207,657 | A | 5/1993 | Gibilisco | |
| 5,234,138 | A | 8/1993 | Laforcade | |
| 5,415,312 | A | 5/1995 | Mueller | |
| 5,695,084 | A | 12/1997 | Chmela et al. | |
| 5,836,466 | A | 11/1998 | Briere | |
| 5,865,330 | A | 2/1999 | Buono | |
| 6,050,274 | A | 4/2000 | Gelardi | |
| 6,050,434 | A | 4/2000 | McNab | |
| 6,279,233 | B1 | 8/2001 | Cameron | |
| 6,289,906 | B1 | 9/2001 | Vanden Dries | |
| 6,295,735 | B1 | 10/2001 | Barger | |
| 6,321,923 | B1 | 11/2001 | Wood | |
| 6,325,231 | B1 | 12/2001 | Ketting | |
| 6,399,079 | B1 | 6/2002 | Mehta | |
| 6,409,034 | B2 | 6/2002 | Schorner | |
| 6,454,130 | B1 | 9/2002 | Miller | |
| 6,478,184 | B2 | 11/2002 | Berge | |
| 6,510,971 | B1 | 1/2003 | Martin | |
| 6,523,711 | B1 | 2/2003 | Hughes | |
| 6,585,136 | B1 | 7/2003 | Stern | |
| 6,604,645 | B1 | 8/2003 | Vaupotic | |
| 6,688,469 | B1 | 2/2004 | Barnes | |
| 6,761,283 | B1 | 7/2004 | Gilliam et al. | |
| D530,203 | S | 10/2006 | Li | |
| 7,134,575 | B2 | 11/2006 | Vogel | |
| 7,213,620 | B2 | 5/2007 | DeJonge | |
| 7,325,708 | B2 | 2/2008 | Barber | |
| 7,451,896 | B2 | 11/2008 | Robinson | |
| 7,617,954 | B2 | 11/2009 | Skillin | |
| 7,762,438 | B2 | 7/2010 | Skilin | |
| 7,882,989 | B2 | 2/2011 | Briles | |
| 7,997,412 | B2 | 8/2011 | Henry et al. | |
| 8,220,670 | B2 | 7/2012 | Moribata | |
| 8,403,159 | B2 | 3/2013 | Antier | |
| 8,459,504 | B2 | 6/2013 | Braxton | |
| 8,590,734 | B2 | 11/2013 | Giraud | |
| 8,622,260 | B2 | 1/2014 | Maietta | |
| 8,657,155 | B2 | 2/2014 | Dwork | |
| 8,950,635 | B2 | 2/2015 | Loya | |
| 8,955,705 | B2 | 2/2015 | Vogel | |
| 8,978,908 | B2 | 3/2015 | Lilienthal | |
| 9,475,619 | B2 | 10/2016 | Procter | |
| 10,173,811 | B2 | 1/2019 | Stevens | |
| 10,336,512 | B2 | 7/2019 | Stoneberg | |
| 10,843,848 | B2 * | 11/2020 | Loya | B65D 47/0838 |
| 2003/0029868 | A1 | 2/2003 | Davidov | |
| 2004/0094548 | A1 | 5/2004 | Laveault | |
| 2004/0238540 | A1 | 12/2004 | Jackel | |
| 2006/0157516 | A1 | 7/2006 | Barber | |
| 2007/0164045 | A1 | 7/2007 | Wydler et al. | |
| 2008/0112750 | A1 | 5/2008 | Thomson | |
| 2009/0101618 | A1 | 4/2009 | Seelhofer | |
| 2010/0140266 | A1 | 6/2010 | Lohrman | |
| 2011/0309078 | A1 | 12/2011 | Rathbone | |
| 2012/0103985 | A1 | 5/2012 | Dwork | |
| 2012/0114800 | A1 | 5/2012 | Mckay | |
| 2015/0368011 | A1 | 12/2015 | Groubert | |
| 2016/0068313 | A1 | 3/2016 | Hart | |
| 2016/0075483 | A1 | 3/2016 | Braxton | |
| 2019/0127133 | A1 | 5/2019 | Rossi | |

* cited by examiner

CAP HAVING A SPOON-SHAPED CLOSURE

RELATED APPLICATIONS

This application is a continuation of U.S. patent application Ser. No. 16/525,305 filed Jul. 29, 2019, now U.S. Pat. No. 10,843,848, which claims priority to U.S. Provisional Patent Application Ser. Nos. 62/711,374 filed Jul. 27, 2018, 62/757,587 filed Nov. 8, 2018, and 62/860,153 filed Jun. 11, 2019, each of which is incorporated herein by reference, in their entirety.

BACKGROUND

Traditionally, it has been difficult for the consumer to find an easy, safe, and convenient way to transport and dispense food, medicine, or other needed substances. Particularly during travel, a caretaker may find himself or herself without a feeding implement, such as a spoon, leaving no way to easily feed their baby. Attempting to feed the baby without the feeding implement may be messy for both the caretaker and the baby. Furthermore, when a measured amount of the product needs to be administered to the baby, the caretaker may lack a measurement means.

The subject matter claimed herein is not limited to embodiments that solve any disadvantages or that operate only in environments such as those described above. Rather, this background is only provided to illustrate one example technology area where some implementations described herein may be practiced.

SUMMARY

The present disclosure relates generally to a cap for use with a container, as well as related systems, devices, and methods. In some embodiments, the cap may include a body, which may include an opening extending through the body. In some embodiments, the opening may include a product pathway extending from an upper surface of the body, a flow restrictor, and a coupling mechanism configured to removably couple the body to the container.

In some embodiments, the cap may include a closure hingedly coupled to the body. In some embodiments, the closure may selectively cover the opening. In some embodiments, the closure may include a spoon shape having a concave surface.

In some embodiments, the upper surface of the body may include a convex surface, which may correspond to the concave surface of the closure. In some embodiments, when the closure is in a closed position, the concave surface may contact the convex surface, and the opening may be sealed.

In some embodiments, the product pathway may be cylindrical. In some embodiments, the product pathway may be angled with respect to a central axis of the body. In some embodiments, the product pathway may exit the upper surface of the body at a location adjacent the concave surface when the closure is in a fully open position. In some embodiments, the closure may be disposed generally parallel to the central axis of the body when the closure is in the fully open position.

In some embodiments, the closure may be hingedly coupled to the body via a living hinge. In some embodiments, the coupling mechanism may include threading or another suitable coupling mechanism. In some embodiments, a dispensing system may include the container and the cap, which may be removably coupled together.

In some embodiments, the body further includes a stop feature located on the body at the base of the closure and in proximity to a living hinge, wherein the stop feature contacts and/or interferes with the base of the closure to define a maximum open position for the closure. In some embodiments, the closure further includes a stop feature located on the closure at the base of the closure and in proximity to a living hinge, wherein the stop feature contacts and/or interferes with the body to define a maximum open position for the closure. In some embodiments, the stop feature prevents over rotation or over extension of the closure. In some embodiments, the stop feature is provided in proximity to, on, or within a hinge between the closure and the body.

In some embodiments, the body may include one or more snap-fit elements. In some embodiments, when the closure is in the closed position, the snap-fit elements may provide resistance to movement of the closure to an open position. In some embodiments, the body may include an outer edge. In some embodiments, when the closure is in the closed position, an outer edge of the closure may contact the outer edge of the body. In some embodiments, the snap-fit elements may extend upwardly from the outer edge of the body. In some embodiments, the snap-fit elements may each include one or more protrusions.

Various embodiments of the present invention may include one or more security features adapted to secure various aspects of the invention from undesired access. For example, some embodiments of the invention comprise a child lock adapted to limit a child's access to and/or ability to operate the one or more elements of the present invention. In some embodiments, the body of the present invention includes one or more cap lock features adapted to prevent undesired removal of the cap from a container, such as by a child. In some embodiments, the body further includes one or more closure lock features adapted to prevent undesired opening of the closure, such as by a child.

It is to be understood that both the foregoing general description and the following detailed description are exemplary and explanatory and are not restrictive of the invention, as claimed. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE SEVERAL VIEWS OF THE DRAWINGS

Example embodiments will be described and explained with additional specificity and detail through the use of the accompanying drawings in which.

DESCRIPTION OF EMBODIMENTS

Figure 1A:
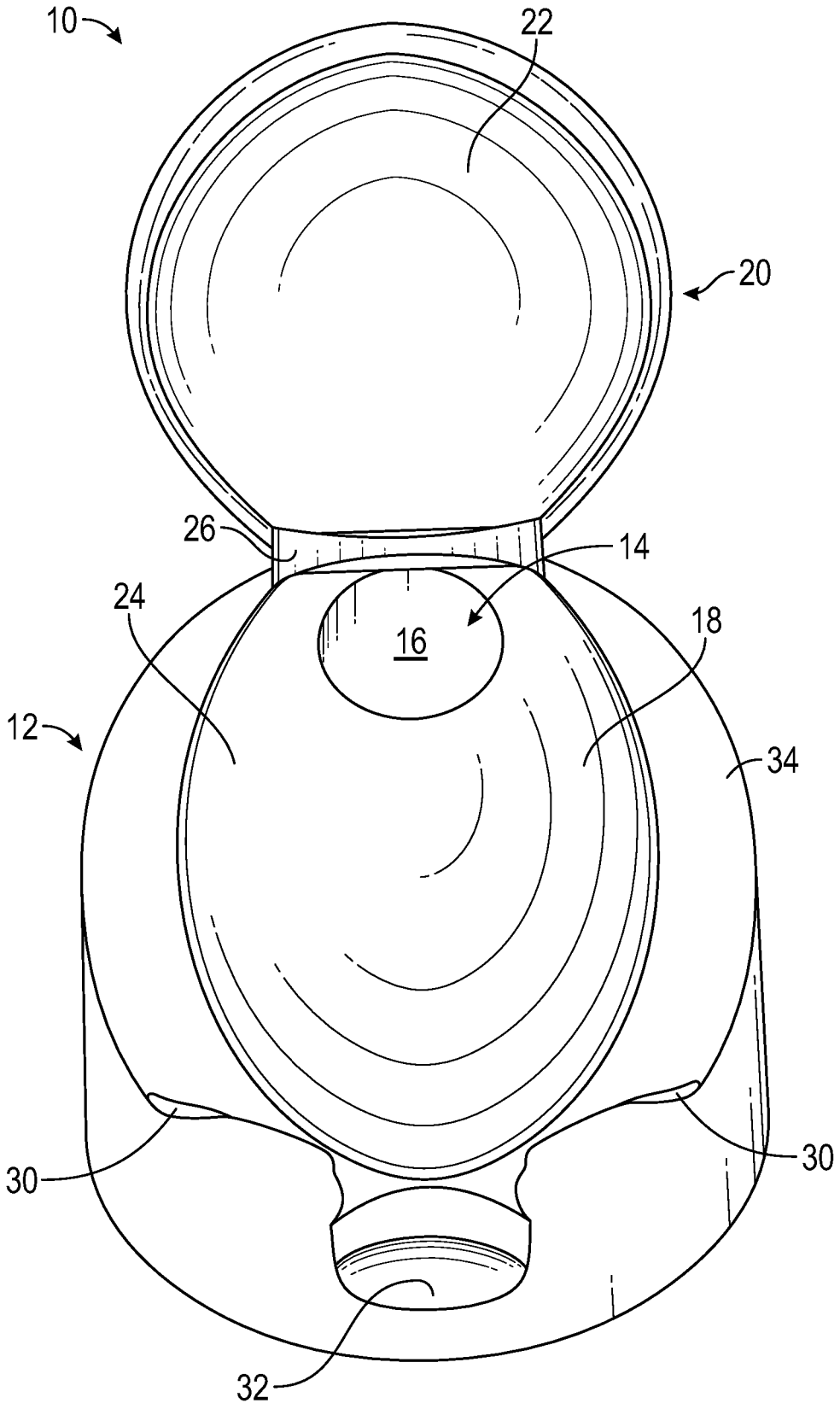
FIG. 1A is an upper perspective view of an example cap, illustrating the cap in an open position, according to some embodiments.

The present disclosure relates generally to a cap for a container, as well as related systems, devices, and methods. Referring now to FIG. 1A, in some embodiments, a cap 10 may include a body 12. In some embodiments, the body 12 may include an opening 14 extending through the body 12. In some embodiments, the opening 14 may include a product pathway 16, which may extend from an upper surface 18 of the body 12. The term "product," as used in the present disclosure, may include any substance dispensable through the product pathway 16, such as, for example, food, baby food, fluid, medicine, etc. The cap 10 may be used to dispense the product to any subject in need, such as, for example, an infant, a baby, a child, an adult, a patient, an elderly person, etc. In some instances, a health care worker, such as, for example, a clinician, a nurse, or a nurse's aide, may dispense the product to the subject via the cap 10. In some embodiments, the cap 10 may be operated with a single hand or with two hands.

In some embodiments, the cap 10 may include a closure 20, which may be hingedly coupled to the body 12. In some embodiments, the closure 20 may selectively cover the opening 14. In some embodiments, the closure 20 may include a spoon shape having a concave surface 22. In some embodiments, concave surface 22 comprises a desired volume, such as, for example, approximately 1 ml, approximately 2 ml, approximately 2.5 ml, approximately 3 ml, approximately 4 ml, approximately 5 ml, approximately 6 ml, approximately 7 ml, approximately 7.5 ml, approximately 8 ml, approximately 9 ml, approximately 10 ml, or greater than 10 ml. In some embodiments, concave surface 22 comprises a volume of 2.5 ml. In some embodiments, concave surface 22 comprises a volume of 5 ml. In some embodiments, concave surface 22 further comprises one or more volume indicators, such as an inscription or protruded marking configured to indicate one or more desired volumes.

FIG. 1A illustrates the closure 20 in an open position, according to some embodiments. In some embodiments, when the closure 20 is in the open position, product may be dispensed through the product pathway 16 into the concave surface 22 of the closure 20 to allow a user to spoon the product held in the closure 20 into his or her own mouth or the mouth of another person. In some embodiments, the closure 20 may facilitate measurement or dosing of the product dispensed from a container coupled to the cap 10. In some embodiments, a size of the concave surface 22 of the closure 20 may be manufactured to be big or small based on, for example, a desired measurement or dosing of the product dispensed from the container.

In some embodiments, the upper surface 18 of the body 12 may include a convex surface 24, which may include a mirror image of the concave surface 22. In some embodiments, when the closure 20 is in a closed position, at least a portion of the concave surface 22 may contact the convex surface 24. In some embodiments, the contact between the concave surface 22 and the convex surface 24 may prevent the product from exiting the cap 10.

In some embodiments, the closure 20 may be hingedly coupled to the body 12 via a hinge 26 disposed between the closure 20 and the body 12. In some embodiments, the hinge 26 may include any suitable type of hinge. In some embodiments, the hinge 26 may include a living hinge. In some embodiments, the hinge 26 may be constructed of a same material as the closure 20 and/or the body 12. In some embodiments, the hinge 26 may be made from an extension of a material of the closure 20 and/or the body 12. In some embodiments, the closure 20 and/or the body 12 may be constructed of one or more materials. In some embodiments, the closure 20 and/or the body 12 may be constructed of plastic, such as, for example, polypropylene or another suitable material.

In some embodiments, the body 12 may include one or more snap-fit elements 30. In some embodiments, when the closure 20 is in a closed position, the snap-fit elements 30 may interlock with the closure 20 to provide resistance to movement of the closure 20 to the open position. In some embodiments, the snap-fit elements 30 may be disposed at various locations on the body 12. In some embodiments, the snap-fit elements 30 may be disposed on an outer edge 34 of the body 12. In some embodiments, the snap-fit elements 30 may contact an upper surface of the closure 20 when the closure 20 is in the closed position. In some embodiments, the body 12 may include a finger hole 32, which may aid the user in moving the closure 20 from the closed position to the open position.

Figure 1B:
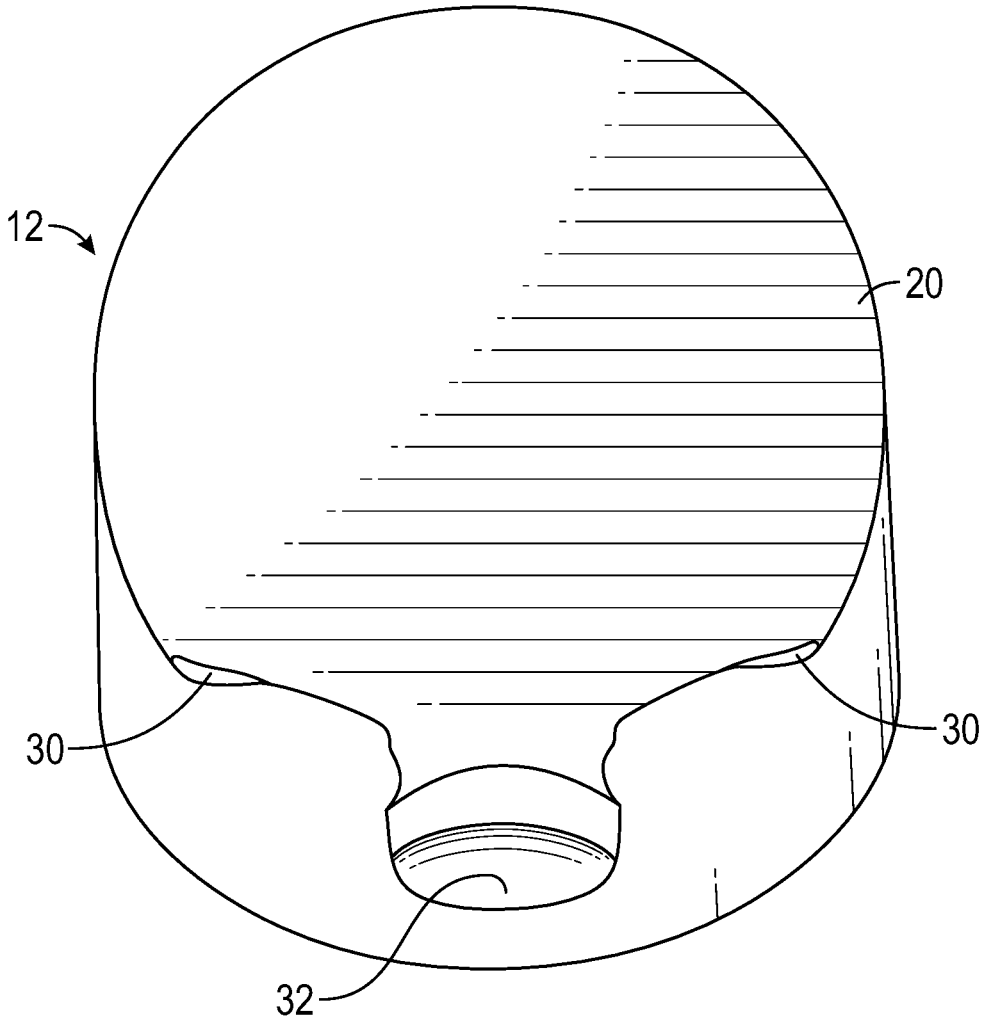
FIG. 1B is an upper perspective view of the cap of FIG. 1A, illustrating the cap in a closed position, according to some embodiments.

Referring now to FIG. 1B, the closure 20 is illustrated in the closed position, according to some embodiments. In some embodiments, an outer edge of the closure 20 may contact the outer edge 34 of the body 12 when the closure 20 is in the closed position.

Figure 1C:
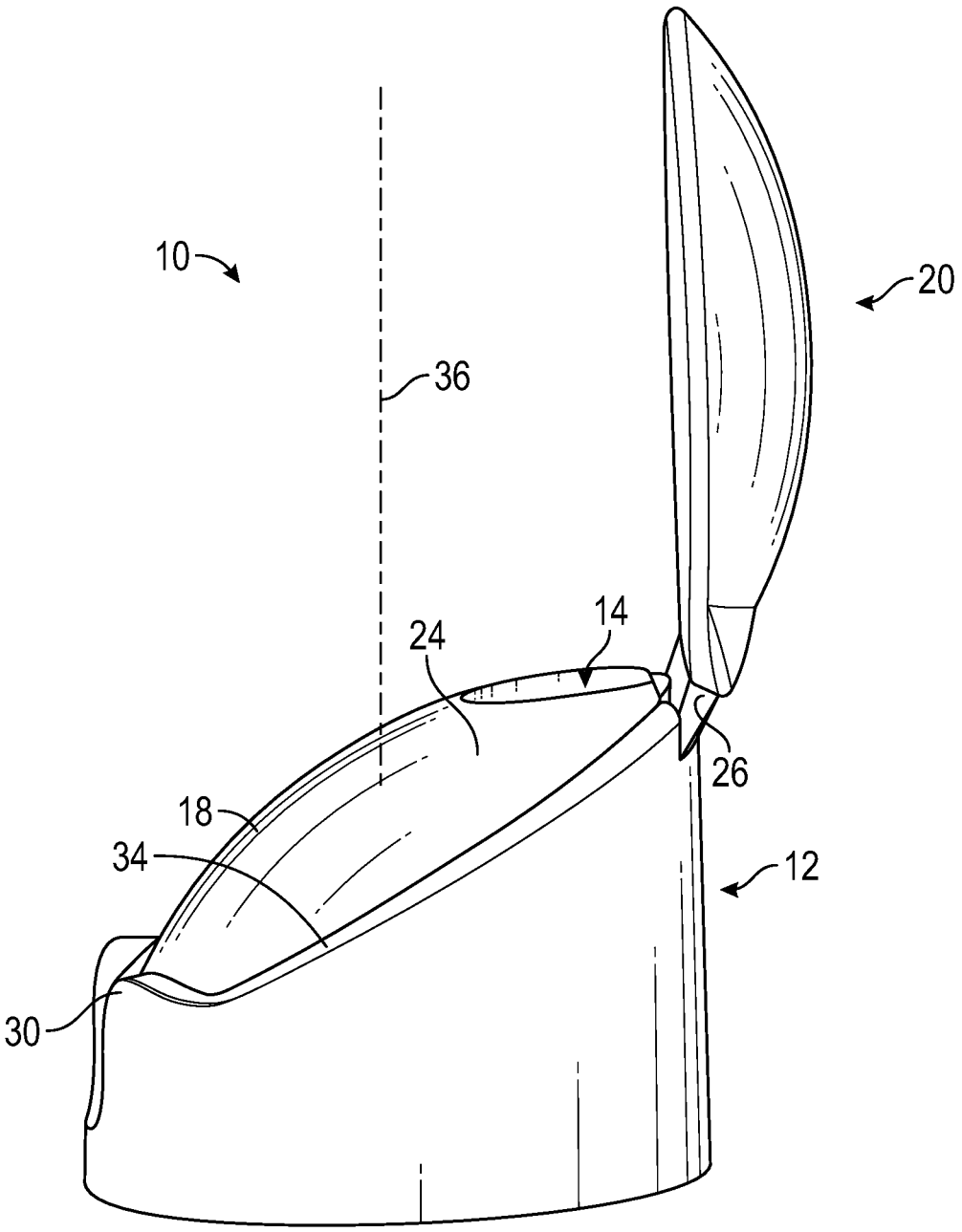
FIG. 1C is a side view of the cap of FIG. 1A, according to some embodiments.

Referring now to FIG. 1C, in some embodiments, the open position may correspond to a fully open position, and the closure 20 may be disposed generally parallel to a central axis 36 of the body 12 when the closure 20 is in the fully open position, as illustrated in FIG. 1C. In some embodiments, the closure 20 may be movable between the open position and the closed position.

Figure 1D:
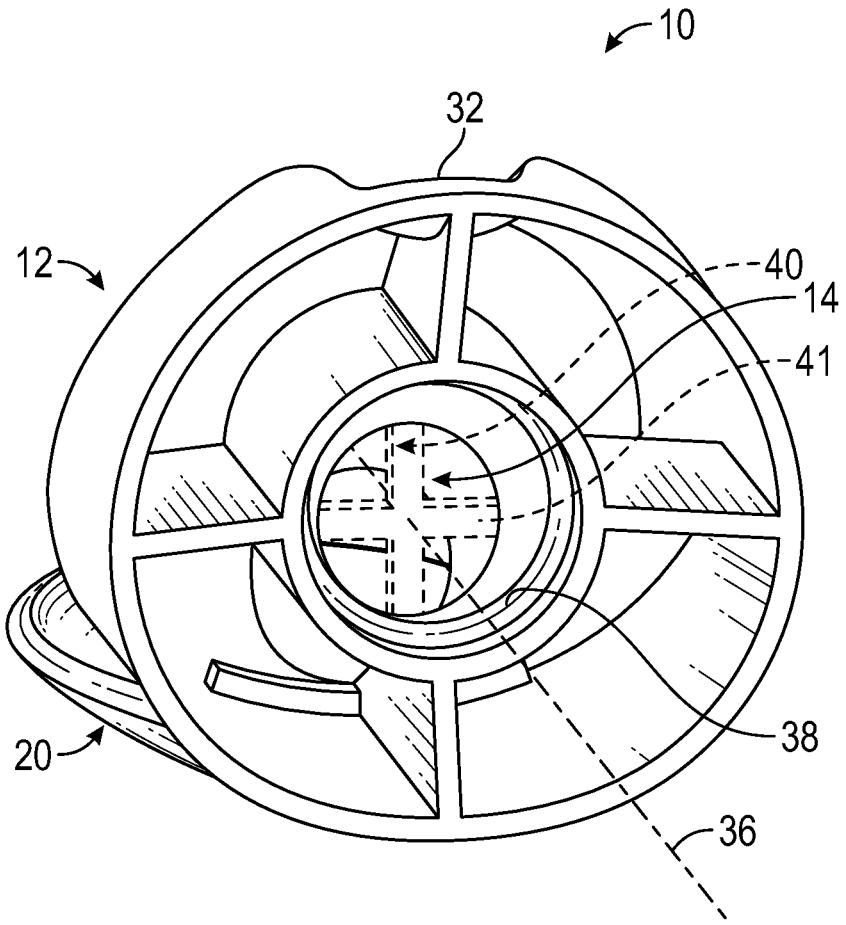
FIG. 1D is a bottom view of the cap of FIG. 1A, according to some embodiments.

Referring now to FIG. 1D, in some embodiments, the opening 14 may include a coupling mechanism configured to removably couple the body 12 to a container. In some embodiments, the coupling mechanism may include threading 38, as illustrated in FIG. 1D, or another suitable coupling mechanism. In some embodiments, the coupling mechanism may include an adhesive, bolt, screw, snap-fit, threading, or combinations thereof.

In some embodiments, the opening 14 may optionally include a flow restrictor 40. In some embodiments, the flow restrictor 40 may be disposed within the product pathway 16 to prevent ejection of larger solid pieces from the container. In some embodiments, the flow restrictor 40 may include one or more dividers 41, which may form a cross shape or another suitable shape. In some embodiments, the flow restrictor 40 may include a net or another suitable straining feature. In some embodiments, opening 14 is provided without a flow restrictor 40.

Figure 1E:
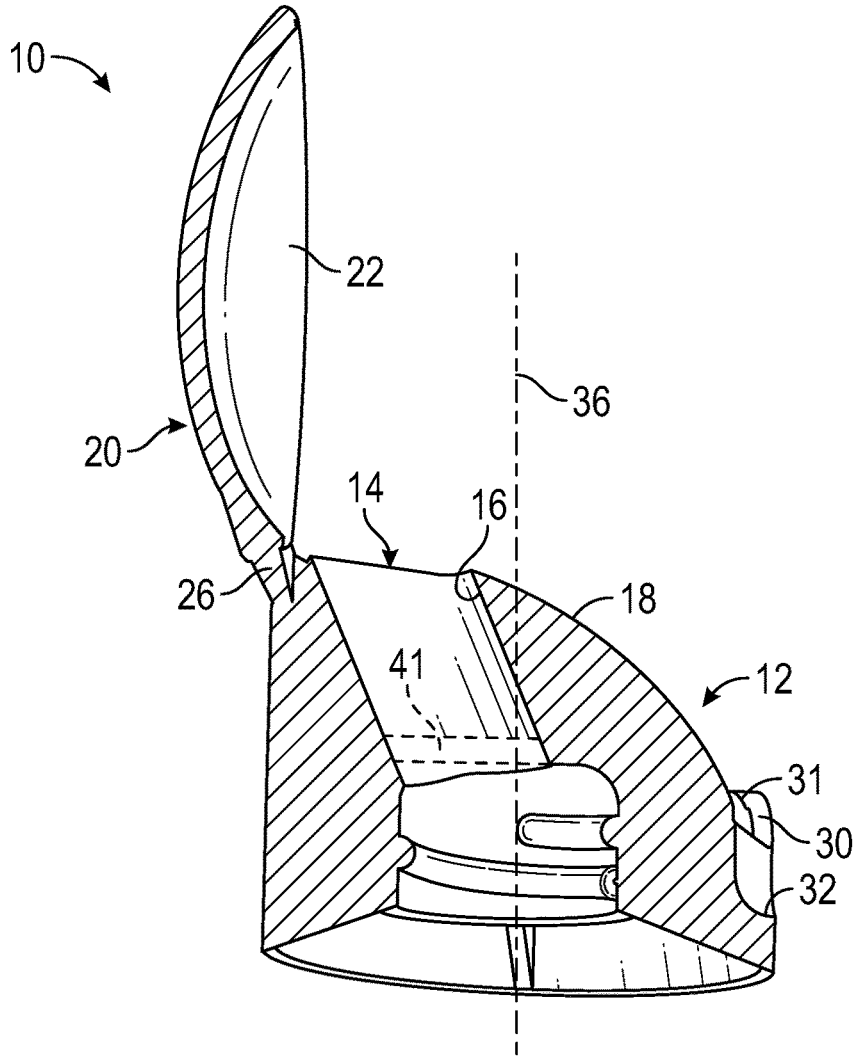
FIG. 1E is a cross-sectional view of the cap of FIG. 1A, illustrating the cap in the open position, according to some embodiments.

Referring now to FIG. 1E, in some embodiments, the snap-fit elements 30 may include various shapes and may interlock with the closure 20 in various ways. As illustrated in FIG. 1E, in some embodiments, the snap-fit elements 30 may include extensions from the outer edge 34 of the body 12 and/or may each include one or more protrusions 31, which may secure the closure 20 in the closed position.

In some embodiments, the snap-fit elements 30 may be disposed on the closure 20 and may secure the closure 20 in the closed position by interlocking with a flange of the body 12. In some embodiments, the closure 20 may include one or more other snap-fit elements, such as grooves, protrusions, etc., that may correspond to a shape of the snap-fit elements 30. For example, in some embodiments, the snap-fit elements 30 may include protrusions, and the other snap-fit elements may include grooves. In some embodiments, the snap-fit elements 30 may include grooves, and the other snap-fit elements may include protrusions. In some embodiments, the snap-fit elements 30 and/or the other snap-fit elements may be disposed at various locations.

As illustrated in FIG. 1E, in some embodiments, the product pathway 16 may be cylindrical or another suitable shape. In some embodiments, the product pathway 16 may be angled with respect to the central axis 36 of the body 12. In some embodiments, the product pathway 16 may be angled such that when the container and the cap 10 are held on their sides or approximately parallel to the horizon, the product disposed within the product pathway 16 flows out of the product pathway 16 into the closure 20 aided by gravity.

In some embodiments, the product pathway 16 may exit the upper surface 18 of the body 12 at an edge of the convex surface 24. In some embodiments, the product pathway 16 may exit the upper surface 18 of the body 12 at a portion of the edge of the convex surface 24 closest to the hinge 26. In some embodiments, the product pathway 16 may exit the upper surface 18 of the body 12 at a location adjacent the concave surface 22 when the closure 20 is in the open position, which may allow the product to flow directly from the product pathway 16 into the closure 20. In some embodiments, the product pathway 16 may be angled such that opening 14 is in proximity to the concave surface 22 of closure 20 and the live hinge 26 when closure 20 is in the open position. In some embodiments, the product pathway 16 may be angled such that a distance between opening 14 and the concave surface 22 of closure 20 is minimal, such as, for example, approximately less than 1 mm, approximately 1 mm, approximately 2 mm, approximately 3 mm, approximately 4, or approximately 5 mm.

Figure 1F:
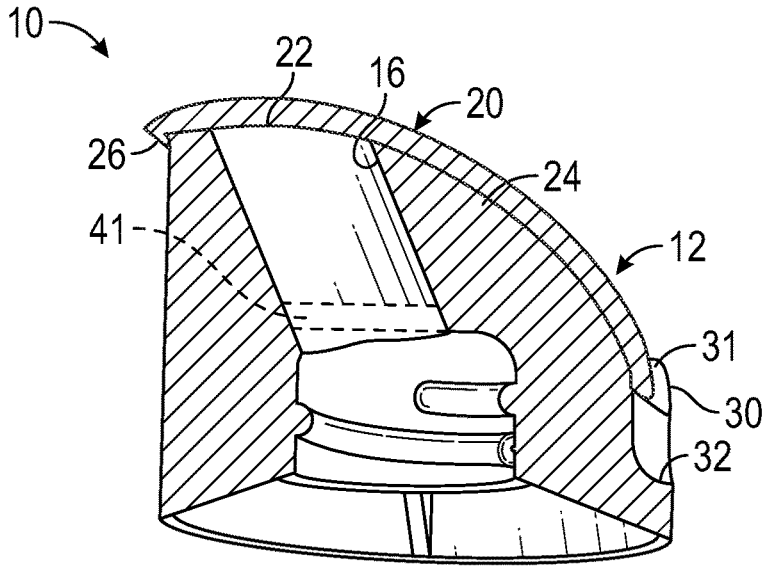
FIG. 1F is a cross-sectional view of the cap of FIG. 1A, illustrating the cap in a closed position, according to some embodiments.

Referring now to FIG. 1F, in some embodiments, when the closure 20 is in a closed position, the concave surface 22 may contact the convex surface 24, and the opening 14 may be sealed, as illustrated in FIG. 1F.

Figure 2A:
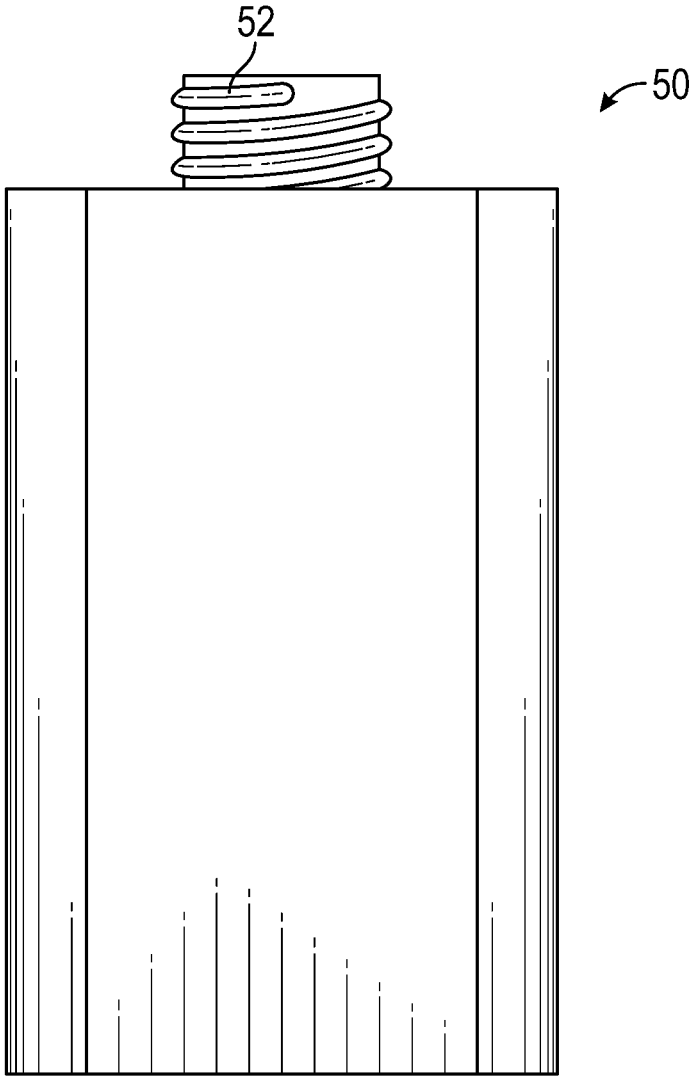
FIG. 2A is an upper perspective view of an example container to which the cap of FIG. 1A may be coupled, according to some embodiments.

Referring now to FIG. 2A, an example container 50 is illustrated, according to some embodiments. In some embodiments, an end of the container 50 may include a coupling mechanism, which may correspond to the coupling mechanism of the cap 10. For example, the coupling mechanism of the container 50 may include threads 52, as illustrated in FIG. 2A. In some embodiments, the container 50 may be hand-compressible to dispense the product stored within the container 50.

Figure 2B:
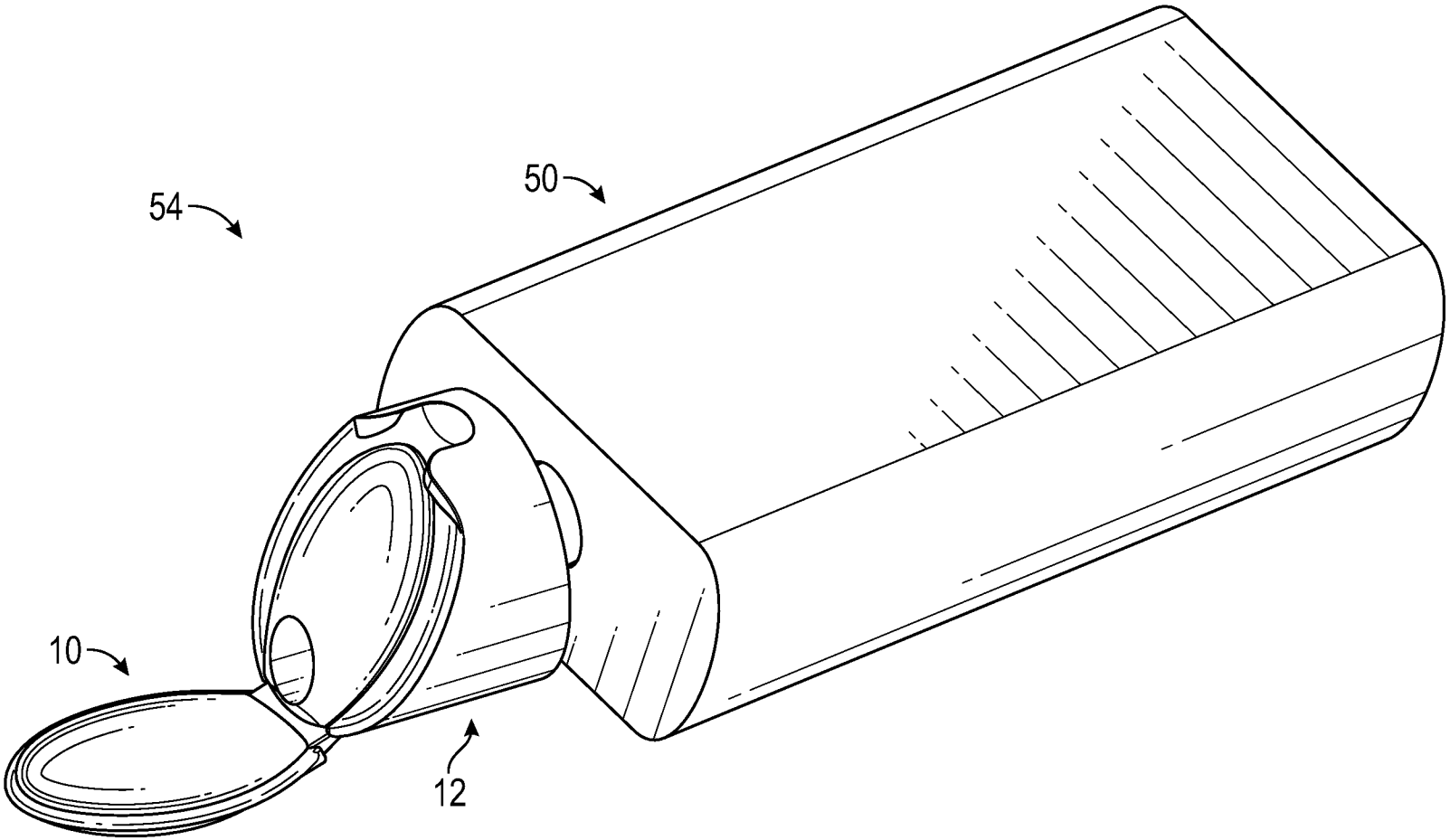
FIG. 2B is an upper perspective view of the cap of FIG. 1A coupled to the container of FIG. 2A, according to some embodiments.
Figure 3A:
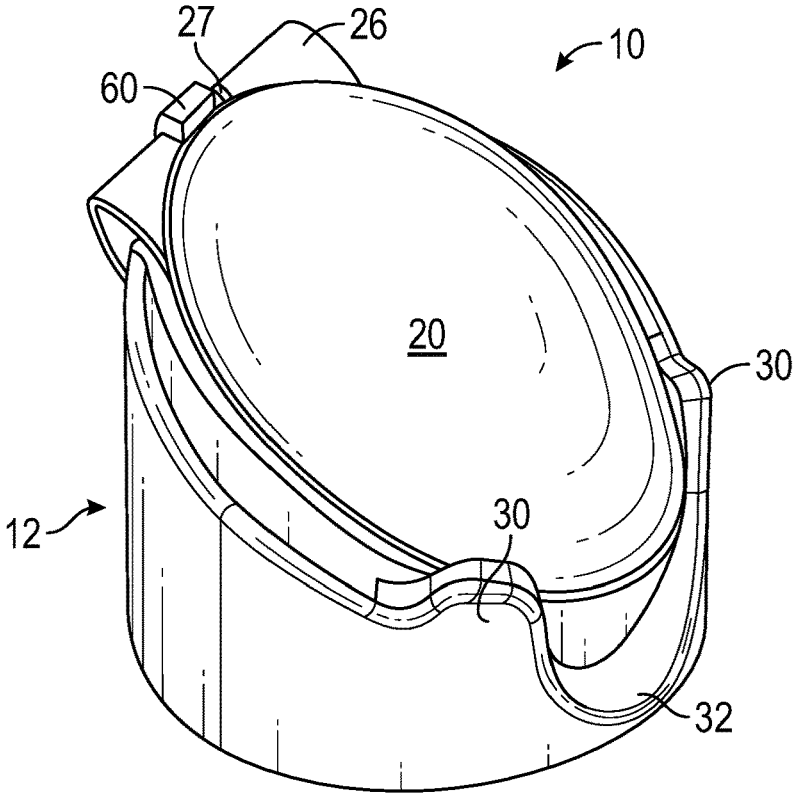
FIG. 3A is an upper perspective view of a cap having a stop feature and a closure in a closed position, according to some embodiments.
Figure 3B:
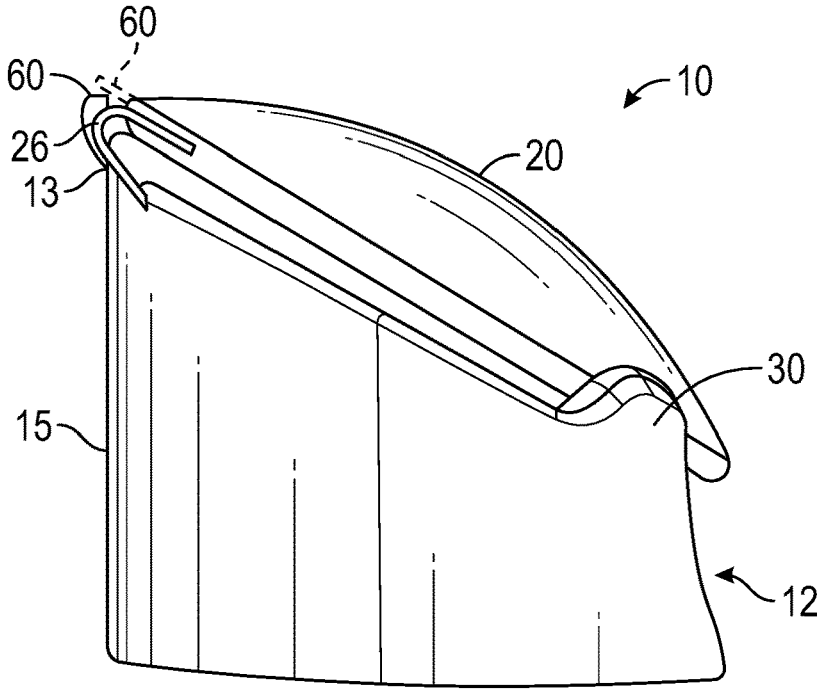
FIG. 3B is a side view of the cap of FIG. 3A, according to some embodiments.
Figure 3C:
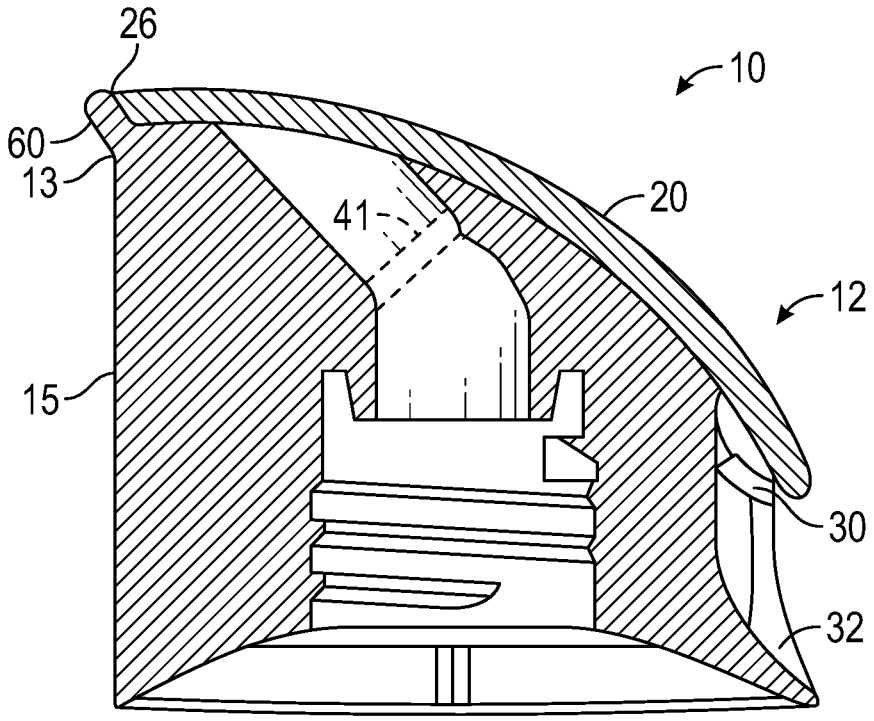
FIG. 3C is a cross-sectional side view of the cap of FIG. 3A, according to some embodiments.

Referring now to FIG. 2B, an example dispensing system 54 is illustrated, according to some embodiments. In some embodiments, the dispensing system 54 may include the cap 10 removably coupled to the container 50. In some embodiments, the container 50 may include one or more features of the elongated package described in U.S. Pat. No. 8,950,635, filed Mar. 5, 2013, entitled "UNITARY PRODUCT—DISPENSING CONTAINER HAVING A COMBINED CAP AND FEEDING/DOSING DISPENSER," which is hereby incorporated by reference in its entirety.

Referring now generally to FIGS. 3A through 4D, some embodiments of the present invention further comprise a stop 60 located on the body 12 at the base of the closure 20 and in proximity to the hinge 26, wherein the stop 60 contacts and/or interferes with the base of the closure 20 to limit rotation of the closure 20 to limit and define a maximum open position for the closure 20. Alternatively, in some embodiments stop 60 is located on the closure 20 in proximity to the hinge 26, wherein the stop contacts and/or interferes with the body 12 in proximity to the hinge 26, wherein the stop 60 contacts and/or interferes with the body 12 to limit rotation of the closure 20 to limit and define a maximum open position for the closure 20. Stop 60 may be positioned at any location on body 12, hinge 26, and/or closure 20 that is configured to limit the rotation of the closure 20 to limit and define a maximum open position for closure 20.

Stop 60 may comprise any size, structure, formation or feature compatible with the teaching of the present invention. In some embodiments stop 60 comprises a raised tab or ridge that extends upwardly from a top or uppermost surface 13 of body 12. In some embodiments stop 60 comprises an extension that extends outwardly from an outer perimeter edge of closure 20. In some embodiments, hinge 26 comprises a central opening 27 through which stop 60 extends. In some embodiments, a portion of closure 20 contacts and pivots against stop 60 when in closed and opened positions. Thus, in some instances stop 60 assists in maintaining an intended and desired location of closure 20 throughout a range of movement or rotation of closure 20. In some embodiments, stop 60 is positioned to provide an interference fit for closure 20 between stop 60 and snap-fit elements 30 when in the closed position.

Figure 4B:
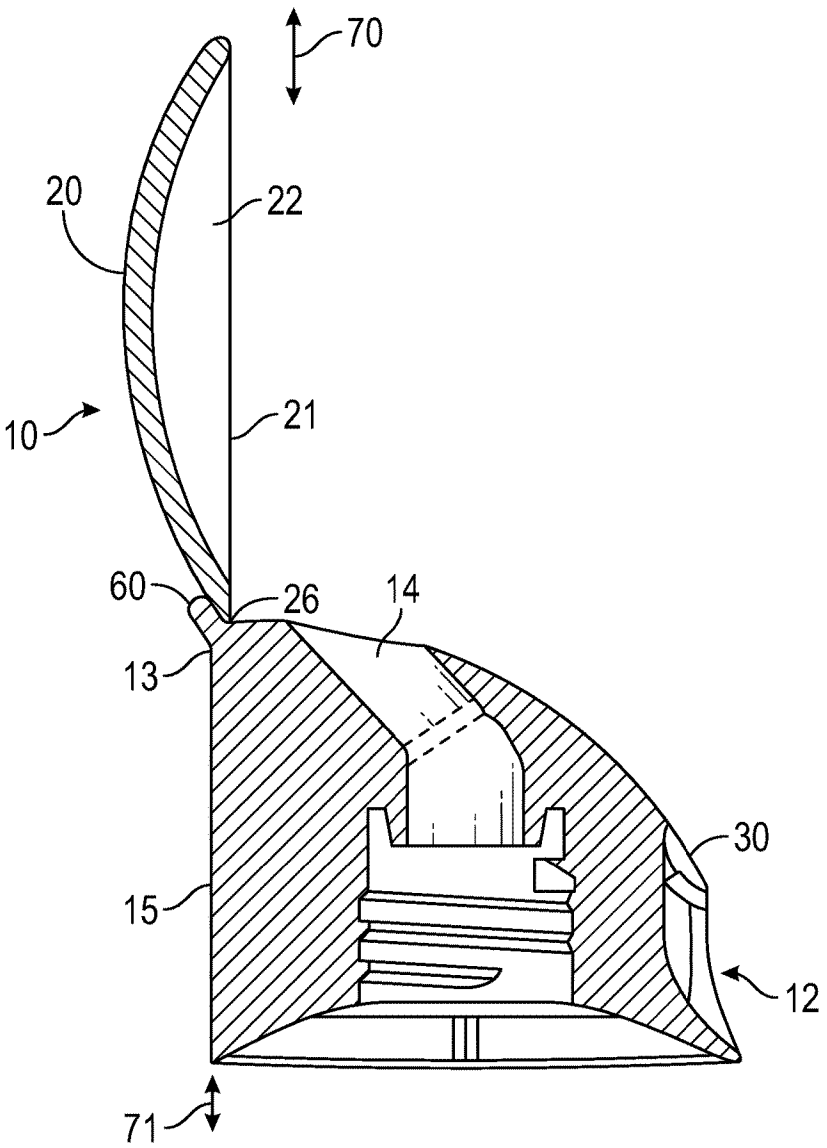
FIG. 4B is a cross-sectional side view of the cap in FIG. 4A, according to some embodiments.
Figure 4A:
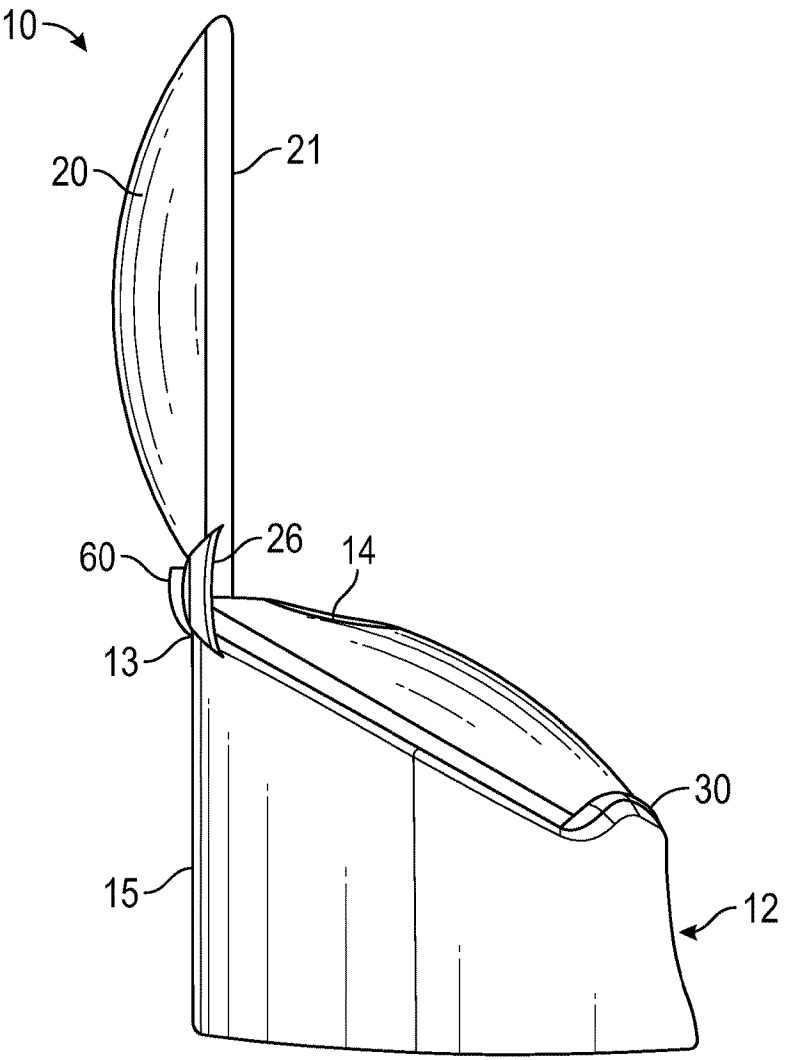
FIG. 4A is a side view of the cap in FIG. 3A with the closure in an opened position, according to some embodiments.

In some embodiments, stop 60 comprises a forward surface that contacts an outer surface of closure 20 when rotated into an opened position, and a rearward surface that forms an extension of rear outer sidewall 15 of body 12. In some embodiments, stop 60 comprises an undersurface that contacts a surface of body 12 when closure 20 is rotated into an opened position. In some embodiments, at least one of the forward surface, rearward surface, and undersurface of stop 60 forms an obtuse angle relative to the rear outer sidewall 15. The angle of stop 60 is selected to provide a maximum opened position for closure 20 wherein a forward-most edge or surface 21 of closure 20 is positioned in a first plane 70 that is parallel to a second plane 71 in which is positioned the rear outer sidewall 15, as shown in FIGS. 4A and 4B. Accordingly, in some embodiments the angle of stop 60 is set to match an angle of the outer surface of closure 20 proximal to stop 60, such that when the closure 20 contacts stop 60, the forward-most edge or surface 21 of closure 20 is position in first plane 70, or approximately 180° relative rear outer sidewall 15.

Stop 60 is generally sufficiently rigid to prevent over rotation of closure 20 into an opened position. However, in some embodiments stop 60 comprises a desired degree of compliancy that prevents over rotation of closure 20, yet permits minimal flex of closure 20 to prevent breakage in the event of accidental over rotation, such as during regular use of the device. In some embodiments, stop 60 comprises a polymer material that is identical to the material of body 12. In some embodiments, stop 60, body 12 and closure 20 comprise a monolithic structure, as most clearly shown in FIGS. 3C and 4B.

Figure 4C:
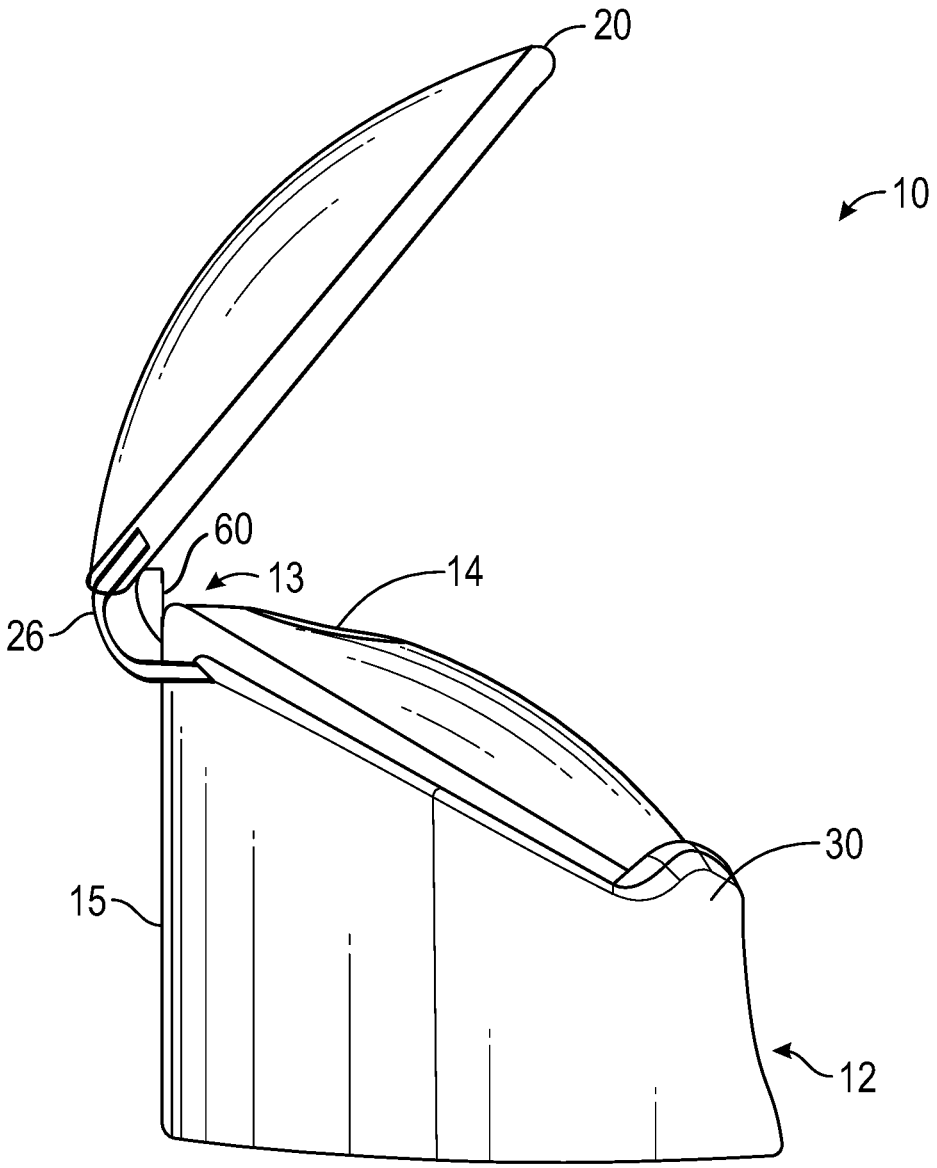
FIG. 4C is a side view of a cap having a closure in a partially-opened position, according to some embodiments.
Figure 4D:
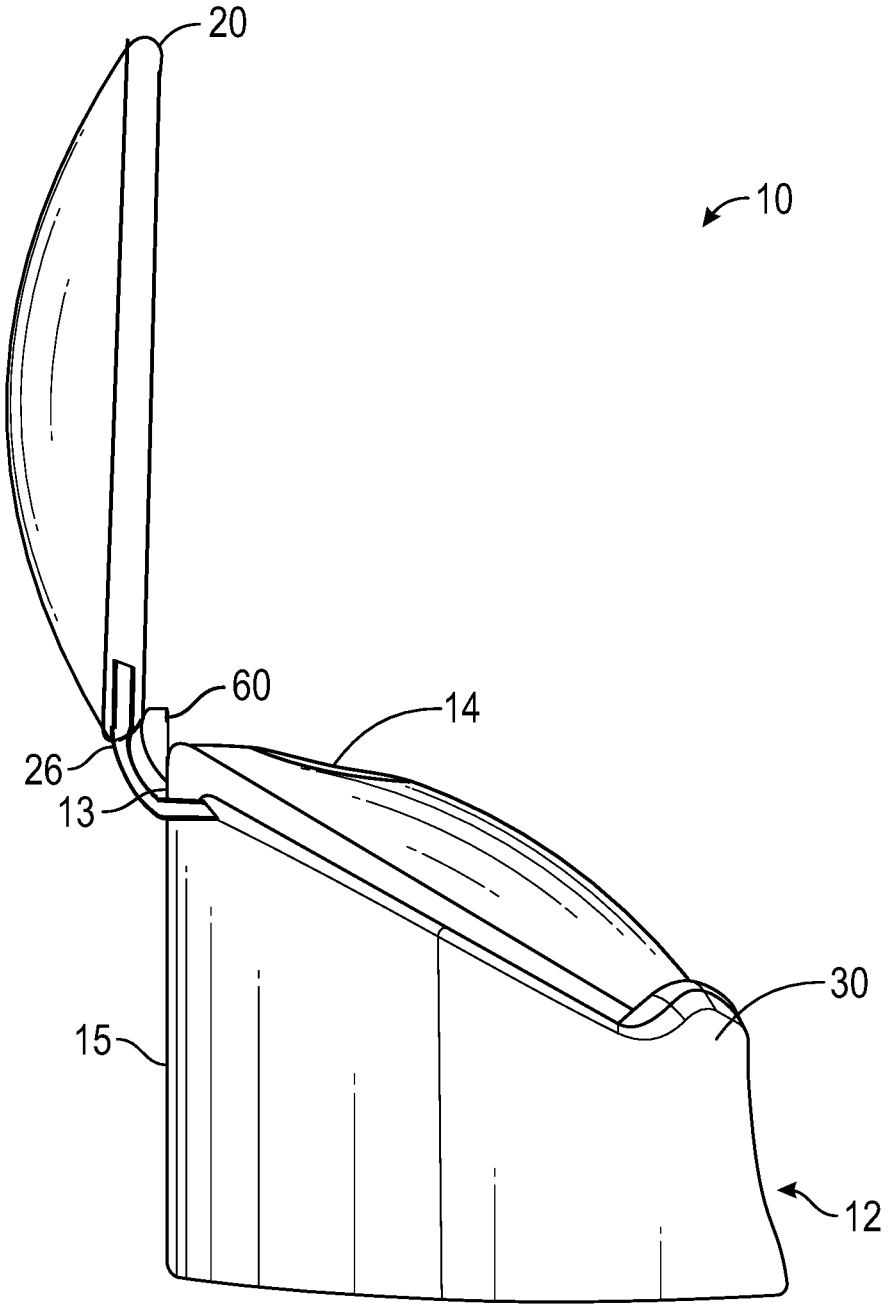
FIG. 4D is a side view of the cap in FIG. 4C with the closure in an opened position; according to some embodiments.

Referring now to FIGS. 4C and 4D, in some embodiments a pivot point is provided between stop 60 and cover 20 at a positioned proximal to hinge 26, wherein hinge 26 is configured to apply a constant tension to maintain contact between stop 60 and cover 20 throughout the rotation of cover 20. In some embodiments, the pivot point between stop 60 and cover 20 is provided on, or in proximity to surface 21 such that stop 60 is positioned in front of and/or in contact with surface 21. In some embodiments, a pivot point between cover 20 and stop 60 is provided via a grooved or catch in surface 21 of cover 20. In some embodiments, hinge 26 provides a tension sufficient to maintain contact between cover 20 and stop 60 at the pivot point, wherein the contact at the pivot point limits the rotation of the closure 20 to limit and define a maximum open position for closure 20. In some embodiments, a plurality of stops are provided, wherein the cumulative effect of the plurality of stops is configured to limit the rotation of the closure 20 to limit and define a maximum open position for closure 20.

Various embodiments of the present invention may include one or more security features adapted to secure various aspects of the invention from undesired access. For example, some embodiments of the invention comprise a child lock feature adapted to limit a child's access to and/or ability to operate the one or more elements of the present invention. In some embodiments, the body of the present invention includes one or more cap lock features adapted to prevent undesired removal of the cap from a container, such as by a child. In some embodiments, the body further includes one or more closure lock feature adapted to prevent undesired opening of the closure, such as by a child.

Figure 5:
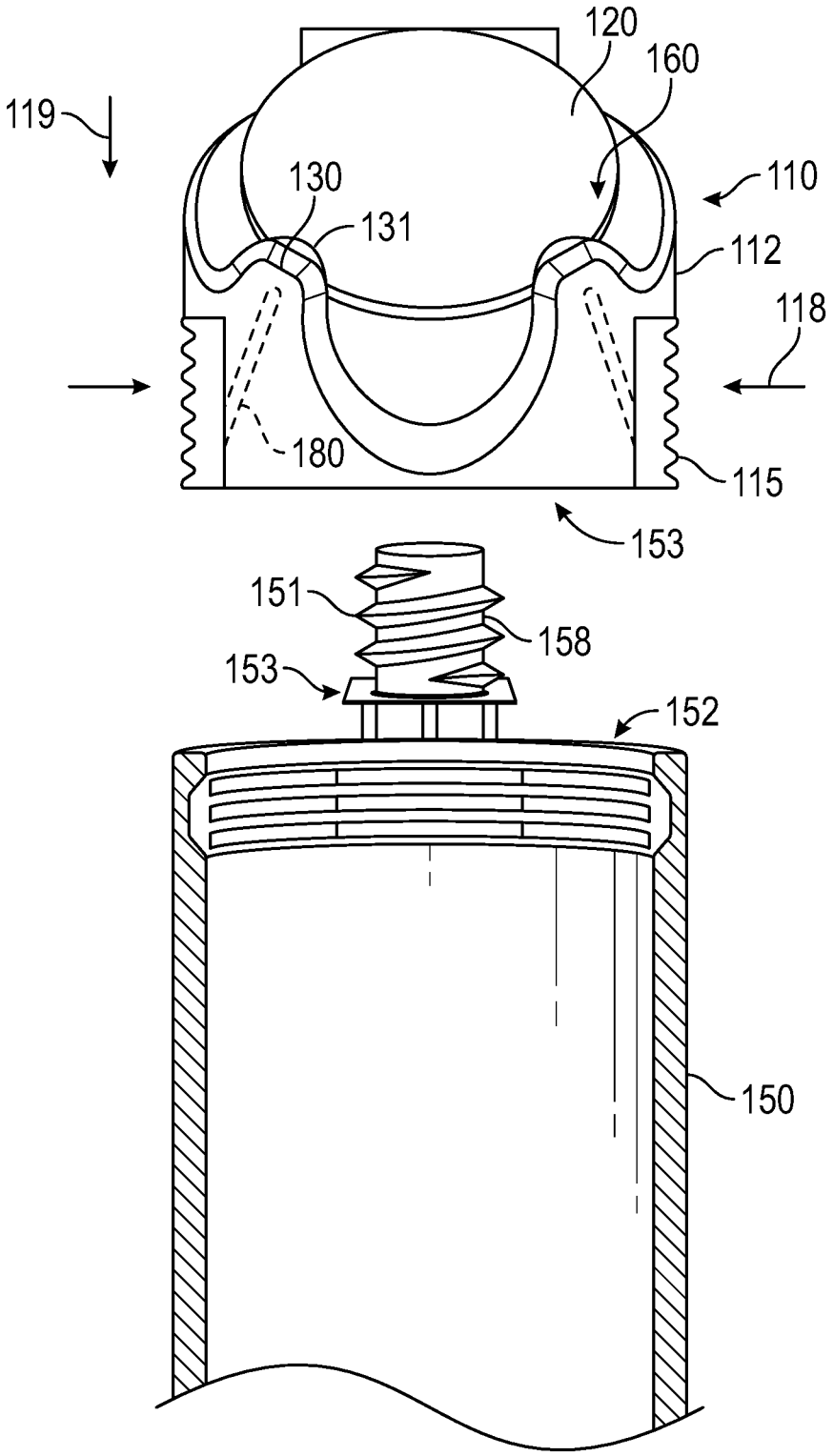
FIG. 5 is a plan front view of a cap and cross-sectional view of a container adapted for use with the cap, said cap and/or container having one or more child lock features, according to some embodiments.
Figure 6A:
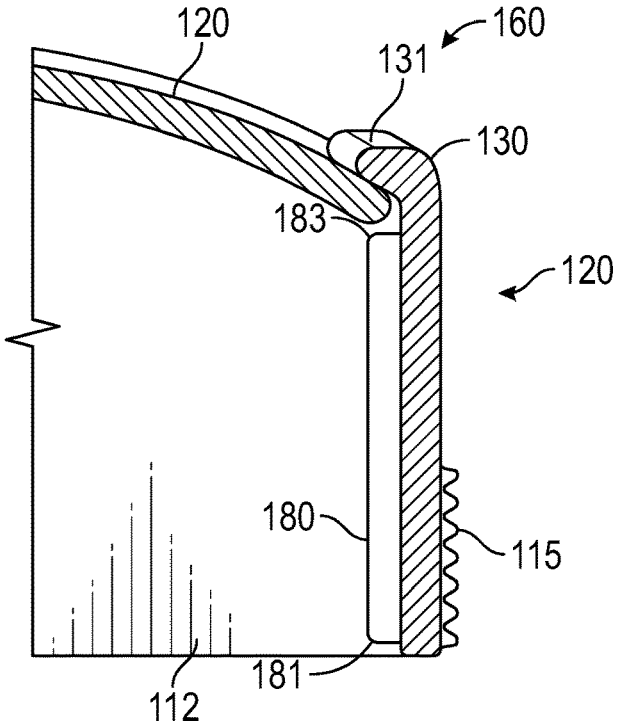
FIG. 6A is a detailed cross-sectional view of a cap in a non-deformed, non-biased configuration, having a closure in a closed position and having a closure lock feature, according to some embodiments.
Figure 6B:
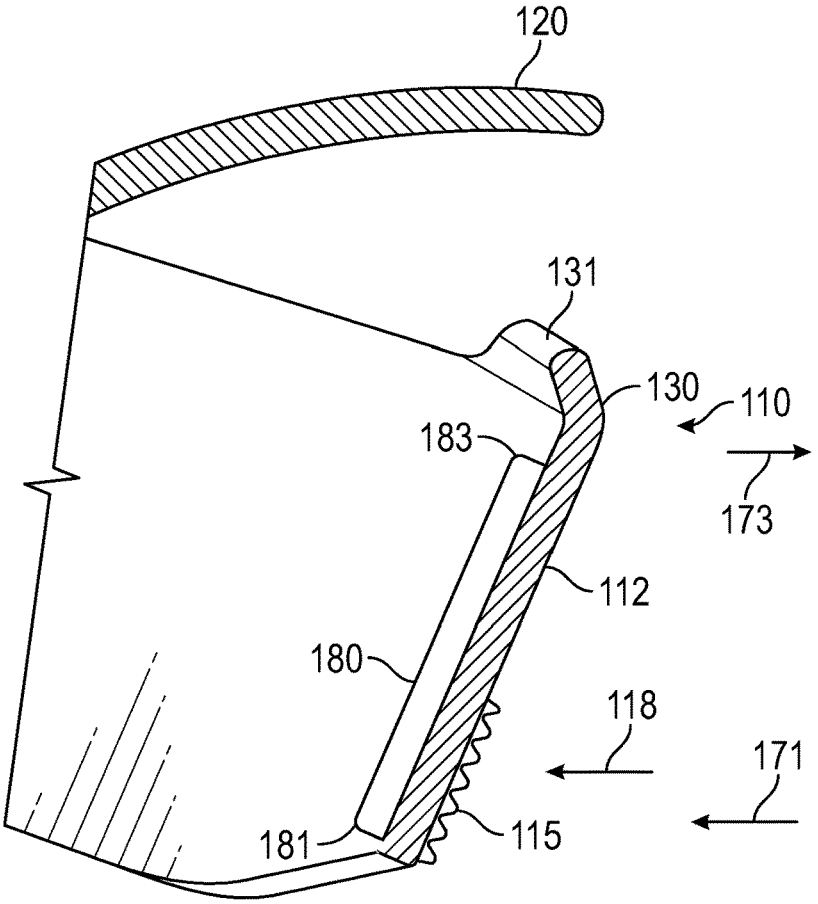
FIG. 6B is a detailed cross-sectional view of a cap in a deformed and/or biased configuration, having a closure in an open position and having a closure lock feature, according to some embodiments.

Referring now to FIGS. 5 through 6B, in some embodiments an interface between cap 110 and container 150 further comprises a cap lock feature 153 which prevents undesired removal of cap 110 from container 150, such as by a child. In some embodiments, a cap lock feature 153 comprises a catch and compatible indent provided on an interior surface of cap 110 and one or more exterior surfaces of container 150. For example, in some embodiments an internal surface of cap 110 comprises a catch, and an external surface of a fitment 156 of container 150 comprises a tab or other surface or feature compatible with the catch provided on cap 110. In some embodiments, a tab or other surface or feature compatible with the catch of cap 110 is provided on a nozzle or spout 158 surface of fitment 156, wherein the tab interfaces and locks with the catch when cap 110 is threadedly coupled to container 150 via threaded interface 151. In some embodiments, cap lock feature 153 comprises any combination of compatible interlocking or otherwise engaging surfaces or features between cap 110 and container 150, wherein the engaging surfaces or features locks the attached relationship of cap 110 and container 150.

In some embodiments, cap lock feature 153 irreversibly locks the attached relationship of cap 110 and container 150. In some embodiments, cap lock feature 153 selectively locks and selectively maintains the attached relationship of cap 110 and container 150, wherein the attached relationship may be undone by manipulating at least one of cap 110 and container 150 to disengage the respective cap lock elements or surfaces of the cap lock feature 153. Once undone, cap 110 and container 150 may be separated from one another.

In some embodiments, the manipulation required to undo the attached configuration of cap lock feature 153 requires a dexterity and/or force that is beyond the abilities of a child. For example, in some embodiments a user is required to apply a downward force 119 on cap 110 in order to undo an attached relationship of cap lock feature 153. In some embodiments, a user is requires to apply an inward force 118 on cap 110 in order to undo an attached relationship of cap lock feature 153. In some embodiments, concurrent downward and inward forces 119, 118 are required to undo an attached relationship of cap lock feature 153. As such, for these embodiments cap lock feature 153 provides a child resistant locked relationship between cap 110 and container 150.

In some embodiments, cap 110 further comprises a closure lock 160 which prevents undesired opening of closure 120, such as by a child. In some embodiments, snap-fit elements 130 comprise a closure lock 160 adapted to lock closure 120 in a closed position. In some embodiments, snap-fit elements 130 comprise one or more extended protrusions 131 that overlaps closure 120 when closure 120 is in a closed position, as shown in FIGS. 5 and 6A. In some embodiments, body 112 is temporarily deformed and extended protrusion 131 is temporarily biased outwardly 173 as closure 120 is moved into a closed position, wherein the temporary deformation and outward biasing of these elements permits a rim edge of closure 120 to bypass protrusion 131. In some embodiments, a user manually deforms and biases these elements by applying an inward force 118 on an outer surface of cap 110, such as by applying force 118 at designated contact points 115. Once closure 120 is in a closed position, the resilient material properties of cap 110 restores the deformed and biased elements to their regular configurations, thereby locking closure 120 in the closed configuration, as shown in FIG. 6A. In some embodiments, a user must release inward force 118 to permit the resilient material properties of cap 110 to restore original configurations of the deformed and biased elements.

In some embodiments, closure lock 160 prevents undesired manipulation of closure 120 from the closed position to an open positions, such as by a child. In some embodiments, closure lock 160 selectively locks and maintains the closed position of closure 120, wherein the closed position of closure 120 may be undone by manipulating cap 110 to deform and/or bias cap 110 and a locked position of extended protrusion 131, as shown in FIG. 6B. In some embodiments, cap 110 and extended protrusion 131 are temporarily deformed and/or biased by applying an inward force 118 on an exterior surface of cap 110, such as at contact points 115. In some embodiments, closure lock 160 comprises a rigid or semi-rigid structure 180 adapted to assist a user in selectively deforming and/or biasing the positions of cap 110 and protrusion 131. In some instances, structure 180 comprises an internal rib of thickened cap material, or other suitable feature or element, wherein structure 180 comprises a rigidity that is greater than the rigidity of the remaining portions of cap 110. In some instances, structure 180 comprises a first end 181 corresponding to a contact surface of cap 110, such as contact point 115, and a second end 183 corresponding to, or in proximity to extended protrusion 131. For these embodiments, application of inward force 118 on contact point 115 temporarily biases first end 181 inwardly 171 and biases second end 183 outwardly 173, thereby temporarily removing extended protrusion 131 from the pathway of closure 120, such that closure 120 may bypass extended protrusion 131 to assume an open position, as shown in FIG. 6A.

In some embodiments, the manipulation required to undo closure lock 160 requires a dexterity and/or force that is beyond the abilities of a child. As such, for these embodiments closure lock 160 provides a child resistant cap 110 having a closure in a closed and locked position.

It is to be understood that both the foregoing general description and the following detailed description are exemplary and explanatory and are not restrictive of the invention, as claimed. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The detailed description is, therefore, not to be taken in a limiting sense.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present inventions have been described in detail, it should be understood that the various changes, substitutions, and alterations could be made hereto without departing from the spirit and scope of the invention.

The invention claimed is:

1. A cap for use with a container, comprising:

a body having an upper surface, and a coupling mechanism configured to removably couple the body to a container;

a closure coupled to the body via a hinge;

an opening formed in the upper surface at a location adjacent to the hinge; and a product pathway having a first opening centered about a central axis of the body, and a second opening comprising the opening formed in the upper surface, wherein the product pathway diverges away from the central axis of the body and towards the hinge, and wherein the closure selectively covers the opening formed in the upper surface.

2. The cap of claim 1, wherein when the closure is in a closed position, the closure seals the opening.

3. The cap of claim 1, wherein the product pathway is cylindrical.

4. The cap of claim 1, wherein a first portion of the product pathway is axially centered about the central axis of the body, and a second portion of the product pathway diverges away from the central axis of the body and towards the hinge.

5. The cap of claim 1, wherein the second opening is positioned adjacent to the closure when the closure is in a fully open position.

6. The cap of claim 1, wherein the coupling mechanism comprises threading.

7. The cap of claim 1, wherein the hinge is a living hinge.

8. The cap of claim 1, wherein the body further comprises a snap-fit element configured to selectively retain the closure in a closed position.

9. The cap of claim 1, wherein the body further comprises an outer edge, wherein an outer edge of the closure contacts the outer edge of the body when the closure is in a closed position.

10. The cap of claim 1, wherein the closure is disposed parallel to a central axis of the body when the closure is in a fully open position.

11. The cap of claim 1, wherein the product pathway comprises a flow restrictor.

12. The cap of claim 1, comprising a child lock feature.

13. The cap of claim 1, comprising a stop to limit a rotation of the closure at a maximum open position for the closure.

* * * * *